US009803653B2

(12) United States Patent
Qi et al.

(10) Patent No.: US 9,803,653 B2
(45) Date of Patent: Oct. 31, 2017

(54) HEATER PUMP

(71) Applicant: Johnson Electric S.A., Murten (CH)

(72) Inventors: Yong Qing Qi, Shenzhen (CN); Hong Jian Zhang, Shenzhen (CN); Li Sheng Liu, Shenzhen (CN); Yue Li, Hong Kong (CN)

(73) Assignee: Johnson Electric S.A., Murten (CH)

( * ) Notice: Subject to any disclaimer, the term of this patent is extended or adjusted under 35 U.S.C. 154(b) by 301 days.

(21) Appl. No.: 14/717,212

(22) Filed: May 20, 2015

(65) Prior Publication Data

US 2015/0337859 A1 Nov. 26, 2015

(30) Foreign Application Priority Data

May 20, 2014 (CN) ..... 2014 1 0214753

(51) Int. Cl.

| | |
|---|---|
| ***F04D 29/42*** | (2006.01) |
| ***F04D 29/58*** | (2006.01) |
| ***F04D 13/02*** | (2006.01) |
| ***F04D 1/00*** | (2006.01) |
| ***F04D 29/22*** | (2006.01) |
| ***F04D 29/44*** | (2006.01) |
| ***A47L 15/42*** | (2006.01) |

(52) U.S. Cl.

CPC ..... *F04D 29/5893* (2013.01); *A47L 15/42* (2013.01); *F04D 1/00* (2013.01); *F04D 13/02* (2013.01); *F04D 29/22* (2013.01); *F04D 29/426* (2013.01); *F04D 29/448* (2013.01); *F04D 29/588* (2013.01)

(58) Field of Classification Search

CPC .... F04D 29/026; F04D 29/426; F04D 29/448; F04D 29/5893

See application file for complete search history.

(56) References Cited

U.S. PATENT DOCUMENTS

| | | | | |
|---|---|---|---|---|
| 2,811,107 | A * | 10/1957 | Brill | H02K 5/1282 310/11 |
| 6,736,598 | B2 | 5/2004 | Kleemann et al. | |
| 7,065,292 | B2 * | 6/2006 | Thweatt, Jr. | H05B 3/78 219/546 |
| 7,455,065 | B2 * | 11/2008 | Schrott | A47L 15/4225 134/56 D |
| 7,965,928 | B2 * | 6/2011 | Eichholz | D06F 39/04 392/417 |
| 8,245,718 | B2 | 8/2012 | Busing et al. | |
| 8,358,922 | B2 * | 1/2013 | Stickel | A47J 31/545 392/465 |
| 9,297,553 | B2 * | 3/2016 | Vallejo Noriega | F04D 29/586 |
| 9,371,841 | B2 * | 6/2016 | Verma | A47L 15/4225 |

* cited by examiner

*Primary Examiner* — Ninh H Nguyen

(74) *Attorney, Agent, or Firm* — Muncy, Geissler, Olds & Lowe, P.C.

(57) ABSTRACT

A heater pump includes a motor and a pump assembly. The pump assembly includes a pump housing having an inlet and an outlet. An impeller and a heater are disposed within the pump housing. The heater includes a heater housing having an inner wall, an outer wall, a lower wall and an upper wall forming a heating chamber. A heating element is disposed within the heating chamber. The inner wall defines an inlet channel connecting the impeller with the inlet of the water pump. Water flowing through the pump is heated by contact with the heater housing and/or the heating element.

20 Claims, 7 Drawing Sheets

HEATER PUMP

CROSS REFERENCE TO RELATED APPLICATIONS

This non-provisional patent application claims priority under 35 U.S.C. §119(a) from Patent Application No. 201410214753.2 filed in The People's Republic of China on May 20, 2014, the entire contents of which are hereby incorporated by reference.

FIELD OF THE INVENTION

This invention relates to water pumps and in particular, to a pump having a built-in heater.

BACKGROUND OF THE INVENTION

Mechanical dishwashers spray soapy hot water over dishes to clean them. The water mush be at least 140 degrees to dissolve dishwasher soap and clean greasy dishes. A higher temperature may be used to kill bacteria. In order to heat the water, a heating element is arrange around a water pump to heat the water flowing through the pump. However, it is easy to lose thermal energy from the heating element as the heating element is arranged around an outer surface of the water pump.

Hence there is a desire for a heater pump with a more efficient heating arrangement.

SUMMARY OF THE INVENTION

Accordingly, in one aspect thereof, the present invention provides a heater pump comprising a motor and a pump assembly, the pump assembly comprising: a pump housing having an inlet and an outlet; an impeller; and a heater, wherein the heater comprises a heater housing, and a heating element, the heater housing comprises an inner wall, an outer wall, an upper wall and a lower wall forming a heating chamber accommodating the heating element, the inner wall defines an inlet channel connecting the inlet to the impeller.

Preferably, the inner wall and the outer wall are made of stainless steel material.

Preferably, a diffuser is disposed within the pump chamber and has a plurality of guide vanes spaced from each other for guiding the water to the outlet.

Preferably, the heating chamber is a sealed chamber which is filled with a thermally conductive material for transferring heat from the heating element to the inner wall, lower wall and outer wall of the heater housing.

Preferably, the thermally conductive material is magnesium oxide powder.

Preferably, the heater comprises a power controller which is electrically connected to a temperature sensor arranged to sense the temperature of the water in the pump housing to control operation of the heating element.

Preferably, the outer wall of the heater housing has a plurality of holes.

Preferably, the heating element is a spiral heating tube.

Optionally, the spiral heating tube has a tube made of stainless steel or aluminum.

Preferably, the pump housing is made of a material having a lower thermal conductivity than the material of the heater housing.

Preferably, the pump housing has an end cap, and the upper wall of the heater housing is fixed to the end cap.

Preferably, a plurality of mounts are fixed around the motor for mounting the pump.

Preferably, the pump assembly further comprises an end cap and a pump housing, the end cap, the inlet and the pump housing are integrally formed as a single piece monolithic structure.

Preferably, a heater plug is fixed to the end cap, and the heating element is electrically connected to the heater plug.

Preferably, the motor comprises a shaft, the shaft extends into the pump housing through a bushing, and the impeller is fixed to the shaft.

Preferably, the outer wall, inner wall, and upper wall of the heater housing are integrally formed as a single piece monolithic structure.

Preferably, the outer wall, inner wall, and lower wall of the heater housing are integrally formed as a single piece monolithic structure.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
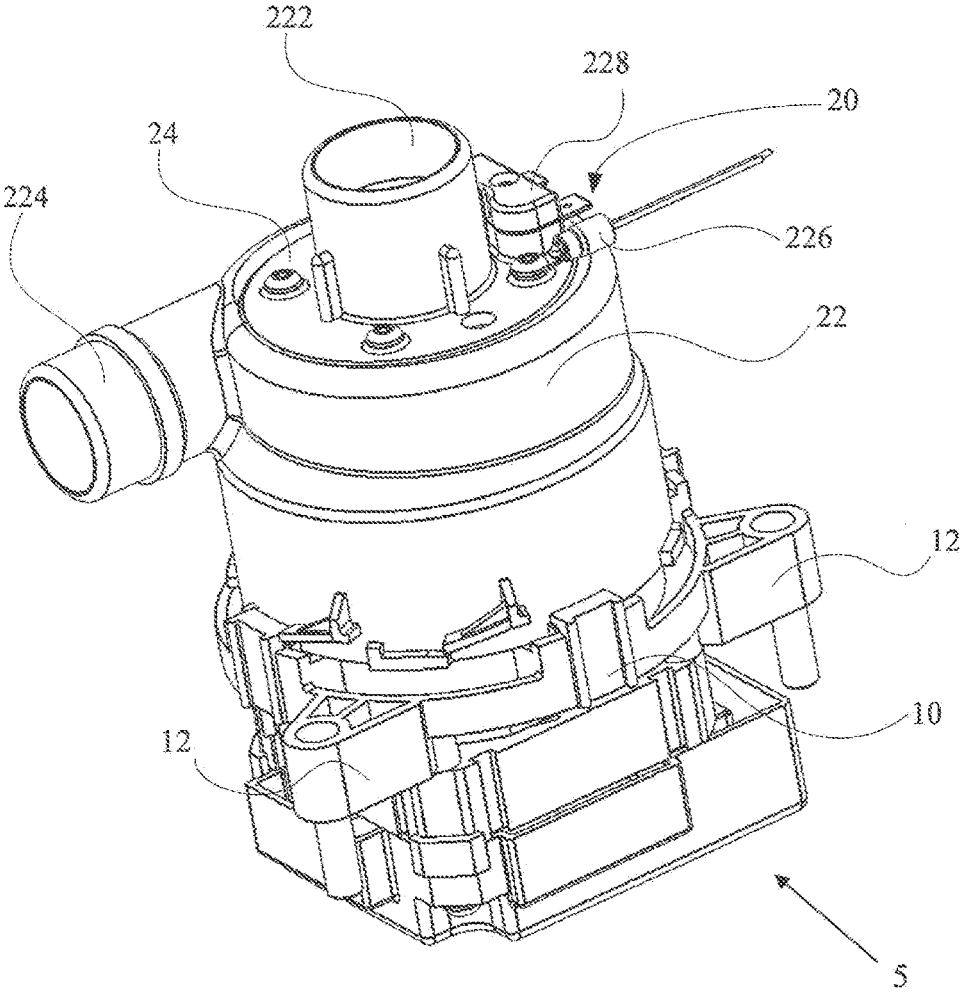
FIG. 1 shows a heater pump in accordance with a preferred embodiment of the present invention.
Figure 2:
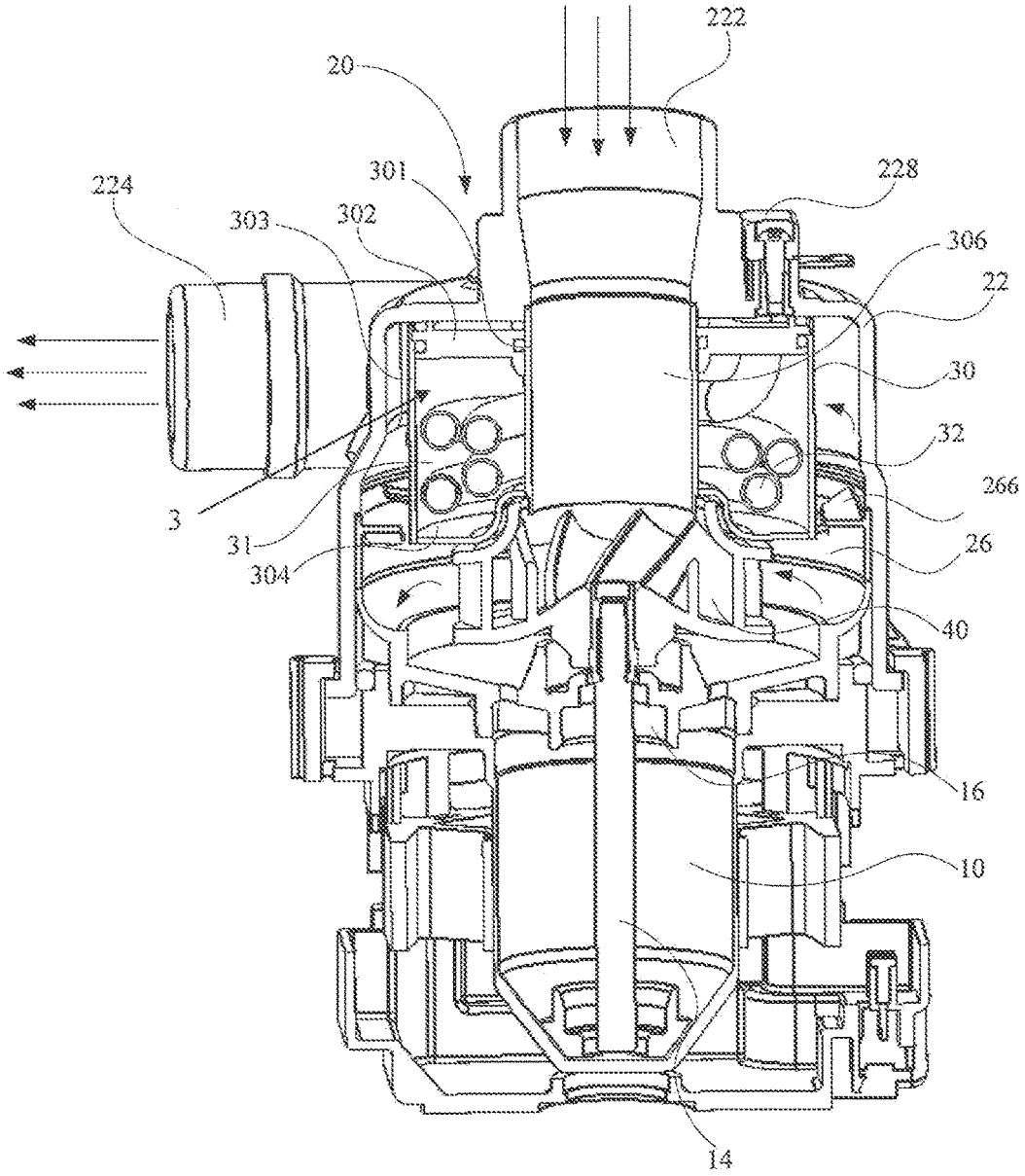
FIG. 2 is a sectional view of the pump of FIG. 1.

A heater pump 5 as shown in FIGS. 1 and 2, includes a motor 10 and a water pump assembly 20 fitted to the motor 10. The pump assembly includes an impeller 40 fixed to a shaft 14 of the motor 10. The heater pump 5 includes a number of mounts 12 fixed around the motor 10 for mounting the pump.

The pump assembly 20 includes a pump housing or volute 22, an inlet 222, an outlet 224 and an end cap 24. Preferably, the end cap 24, inlet 222, outlet 24 and the housing 22 are made integrally as a single piece monolithic structure.

The heater pump 5 further includes a temperature sensor 226 and a heater plug 228 fixed to the end cap 24. The temperature sensor 226 is arranged to sense a current temperature value of water within the volute 20. In one embodiment, the heater plug 228 includes two conductive tab like terminals. The temperature sensor 226 is connected to a temperature controller (not shown) configured to cut off power supplied to the heater plug when a current temperature value sensed by the temperature sensor 226 is greater than a predetermined temperature value, thereby preventing overheating of the heater pump.

The shaft 14 extends into the pump housing 20 to connect with the impeller 40, through a bushing 16. The pump assembly 20 further includes a heater 3.

The heater 3 includes a heater housing 30 and a heating element 32 spirally arranged within the heater housing 30. The heater housing 30 has an inner wall 301, an outer wall 303, an upper wall 302 and a lower wall 304, defining a heating chamber 31. In a first embodiment, the heating chamber 31 is a closed chamber, there are no holes formed on the outer wall 303. The upper wall 302 is sealed to the inner wall 301 and the outer wall 303 through sealing elements, such as O-ring seals. In the first embodiment, the lower wall 304, the inner wall 301 and the outer wall 303 are made integrally as a single piece monolithic structure, preferably from stainless steel. Alternatively, the upper wall 302, the inner wall 301 and the outer wall 303 are made integrally as a single piece monolithic structure. The upper wall 302 and the lower wall 304 have a through hole in a center thereof. The inner wall 301 joins the two through holes to form an inlet channel 306 connecting the inlet 222 with the impeller 40, thereby guiding the water from the inlet 222 to the impeller 40. The pump housing 22 cooperates with the heater housing 30 to form a pump chamber 26 communicating the impeller 40 with the outlet 224. Preferably, the heater housing 30 is made of stainless steel. Alternatively, the heater housing 30 may be made of other thermally conductive materials, such as copper or aluminum.

The upper wall 302 may be fixedly connected to the end cap 24 by screws, thereby fixing the heater 3 to the pump housing 22.

Preferably, the heating element 32 is an electrical heater tube, and is electrically connected to the heater plug 228. Optionally, the tube may be made from aluminum.

Preferably, the heating chamber is filled with a thermally conductive material to increase the efficiency of the heat transfer between the heater element 32 and the heater housing 30. Optionally, the thermally conductive material is magnesium oxide powder. Magnesium oxide powder has a high heat transfer efficiency and quickly transfers heat from the heating element 32 to the heater housing 30 to heat the water within the pump housing 22.

During operation of the heater pump 5, water enters the pump housing 22 via the inlet 222, and flows into the impeller 40 through the inlet channel 306. The impeller 40 pumps the water into the chamber 26. The water flows around the heater housing 30 and is discharged from of the pump housing 22 via the outlet 224. As the water flows through the pump, thermal energy is transferred from the inlet channel 306, the lower wall 304 and the outer wall 303 of the heater housing, to the water, thereby heating the water.

Figure 3:
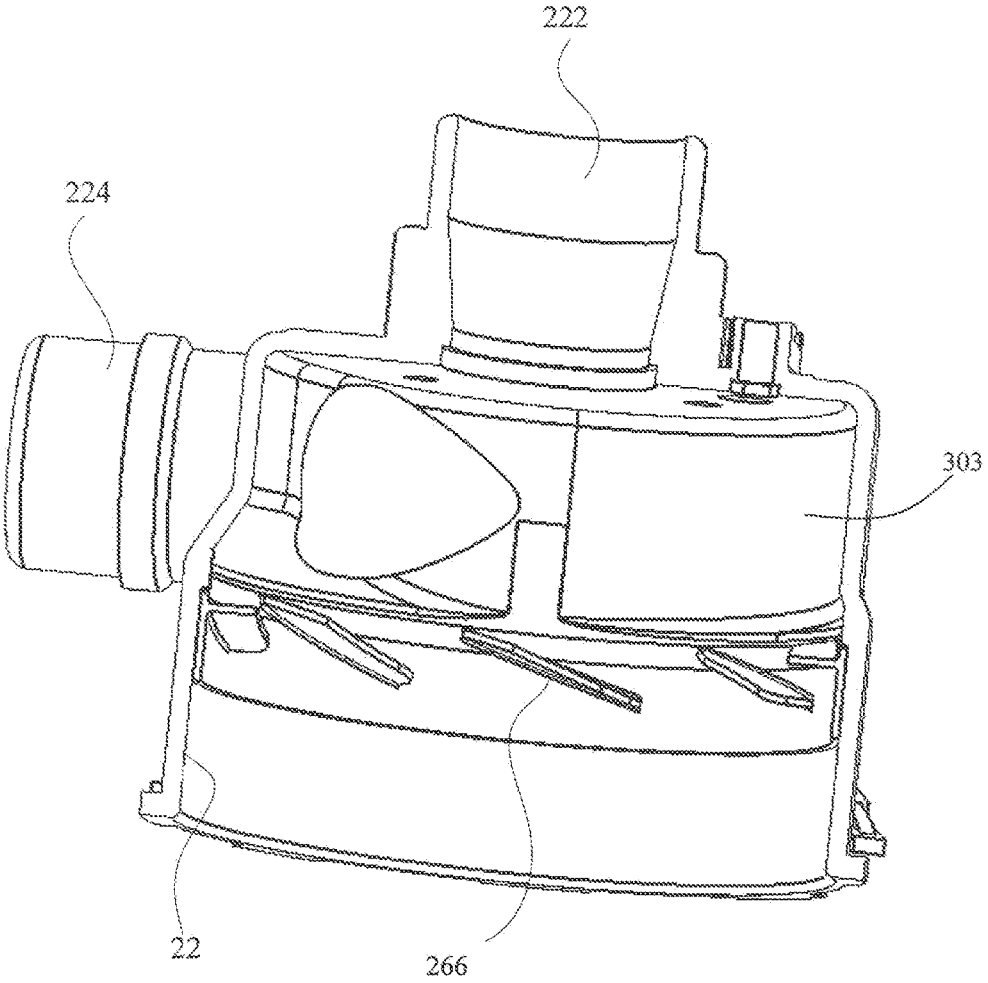
FIG. 3 is a sectional view of a volute and diffuser of the pump of FIG. 2.

Referring to FIG. 3, a diffuser is disposed in the pump housing 22 and has a number of guide vanes 266 spaced from each other. The guide vanes 266 are arranged to guide the water within the chamber 26 from the impeller to the outlet 224. The angle formed between the guide vanes 266 and outer wall 303 and the number of guide vanes 266 can be set according to actual requirements of the pump 5. Preferably the guide vanes encourage the water to swirl about the outer wall 303 of the heater housing 30 on the way to the outlet 224.

Figure 4:
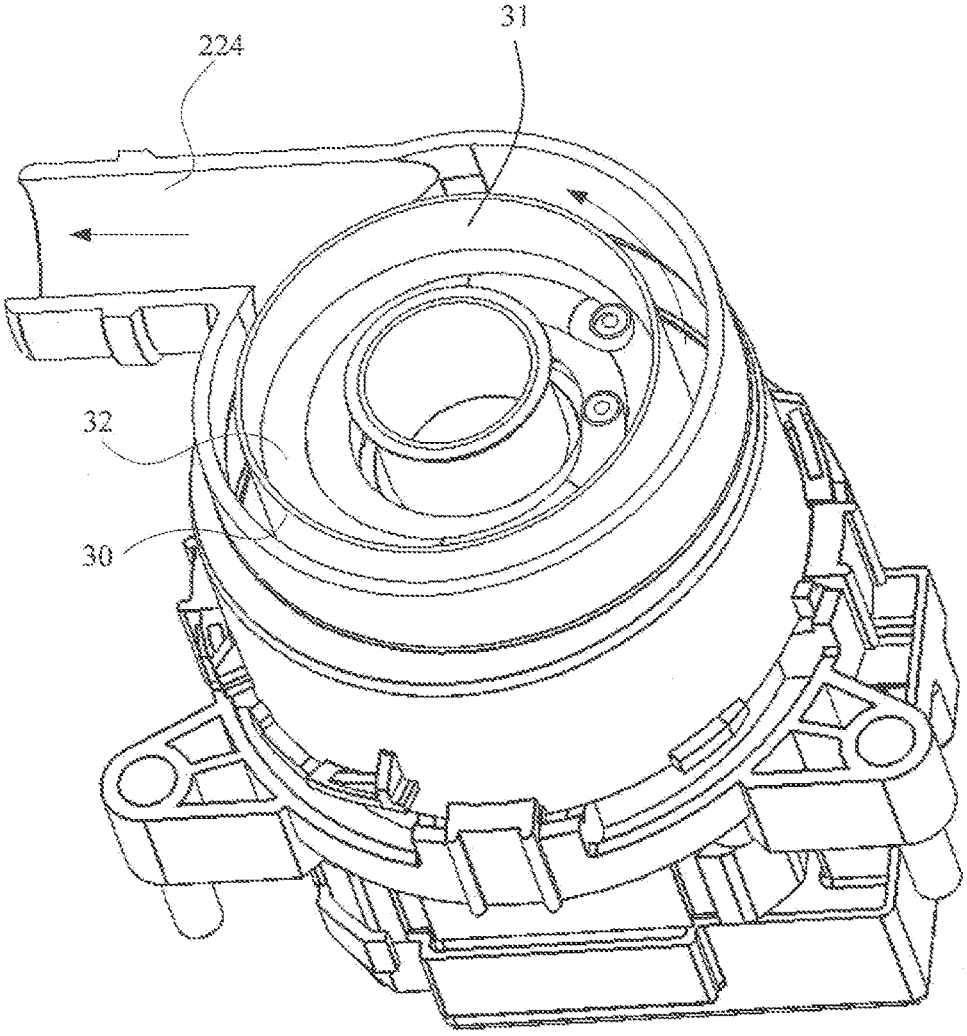
FIG. 4 is a cross-sectional view of the pump of FIG. 1, viewed from above.

As shown in FIG. 4, the heating element 32 is spirally arranged within the heating chamber 31. The water within the pump assembly 20 flows along a path indicated by the arrows and thus is able to absorb heat from the heater as it flows through the pump from inlet to outlet.

Figure 5:
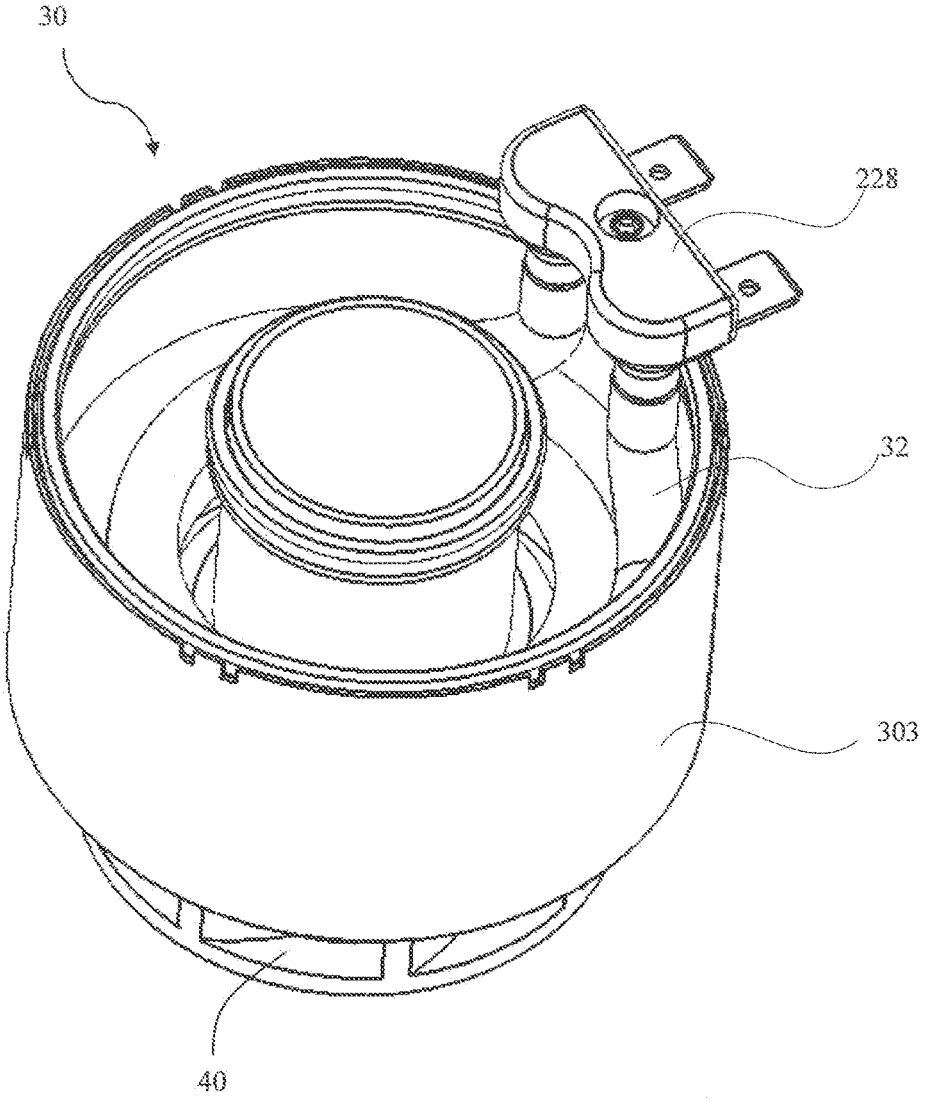
FIG. 5 shows a heater of the pump of FIG. 1.

Referring to FIG. 5, the heating element 32 is electrically connected to the heater plug 228. The heater plug may be connected to a power supply, or be connected to a power controller which controls the supply of power to the heater plug 228 according to a signal from the temperature sensor 226.

Figure 6:
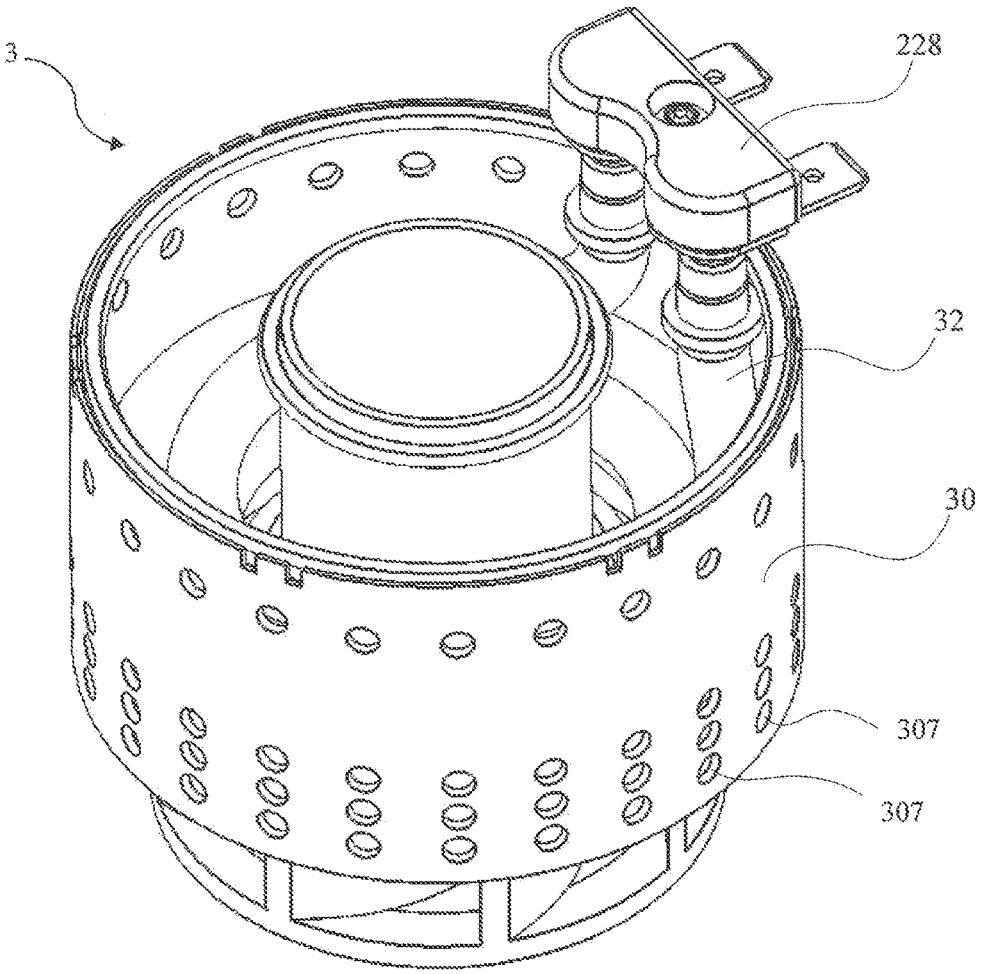
FIG. 6 shows a heater of the pump according to a second embodiment.
Figure 7:
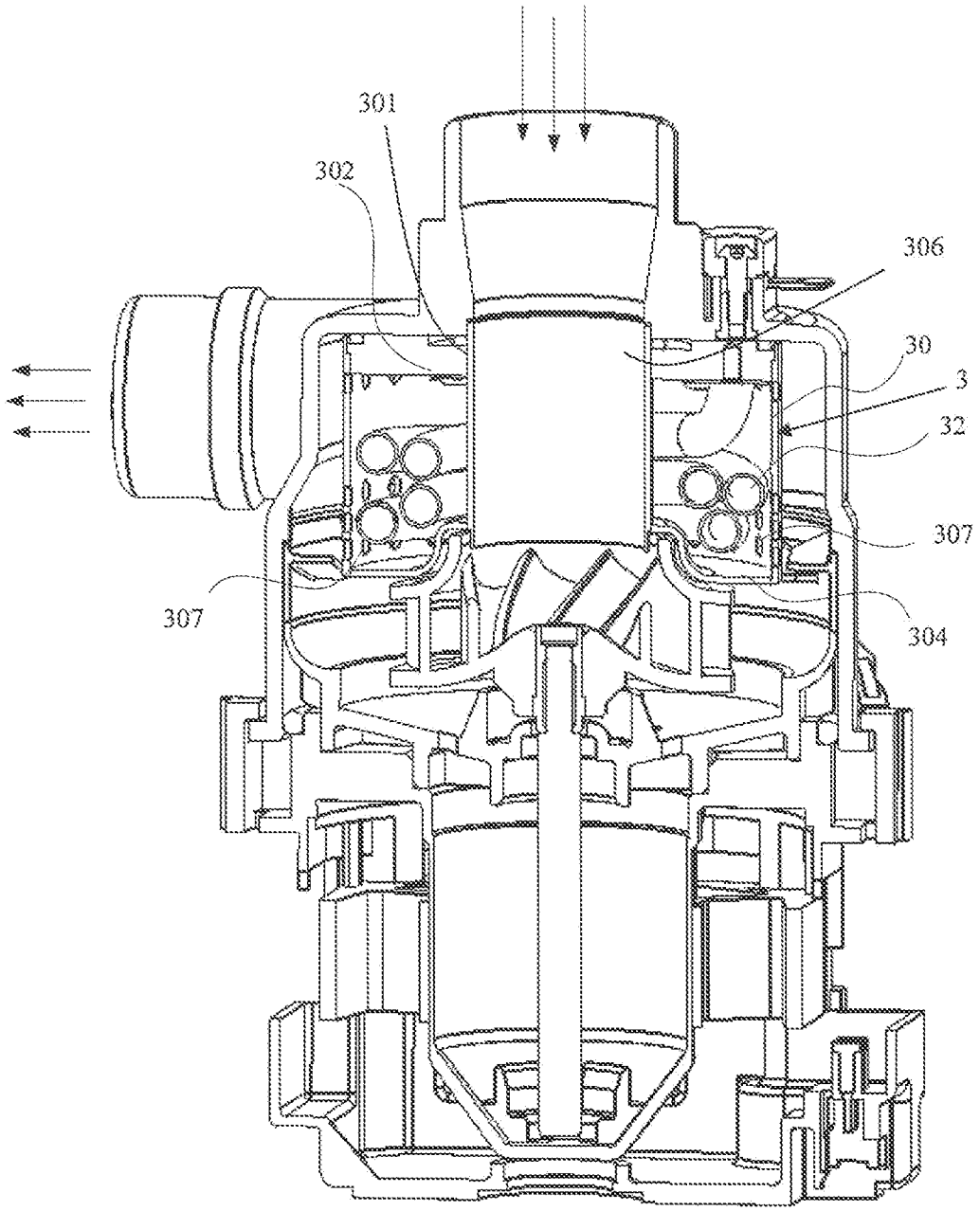
FIG. 7 is a sectional view, similar to FIG. 2, showing the heater of FIG. 6.

Referring to FIGS. 6 and 7, in a second embodiment, the outer wall 303 has a number of holes 307. Water within the pump housing 22 is able to enter the heating chamber 31 through the holes 307 and come into direct contact with the heating element 32. There is no thermally conductive material filling the heating chamber 31, instead the heating chamber 31 is filled with water which helps to transfer the heat from the heating element 32 to the heater housing 30.

During operation of the heater pump 5, water enters the pump assembly 20 via the inlet 222, and flows to the impeller 40 through the inlet channel 306. The impeller 40 pumps the water into the chamber 26 and some of the water will enter the heating chamber 31 through the holes 307 where it is heated by the heating element 32. The heated water heats the heater housing which heats the surrounding water. The heated water also heats the surrounding water as it mixes on the way to the outlet 224. As the water flows through the pump, the water is heated by thermal energy transferred from the heater housing, i.e. from the inner wall 301, the lower wall 304 and the outer wall 303, as well as mixing with the water heated directly by the heating element 32.

The temperature of the water heated by the heater pump 5 of the first embodiment is higher than the temperature of the water heated by the heater pump 5 of the second embodiment as the water is mainly heated by direct contact with the heating element 32 in the second embodiment.

Preferably, in the second embodiment, the heating element 32 is an electrical heating tube. The tube and the heater housing 30 are made of stainless steel material. Optionally, the pump housing 22 of the pump assembly 20 is made of material having lower thermal conductivity than the heater housing, thereby reducing heat dissipation and saving energy.

In the description and claims of the present application, each of the verbs "comprise", "include", "contain" and "have", and variations thereof, are used in an inclusive sense, to specify the presence of the stated item or feature but do not preclude the presence of additional items or features.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of example only, and various other modifications will be apparent to persons skilled in the field without departing from the scope of the invention as defined by the appended claims.

The invention claimed is:

1. A heater pump comprising:

a motor; and a pump assembly, the pump assembly comprising:

a pump housing having an inlet and an outlet;

an impeller; and a heater, wherein the heater comprises:

a heater housing; and a heating element, wherein the heater housing comprises an inner wall, an outer wall, an upper wall and a lower wall forming a heating chamber accommodating the heating element, the inner wall defines an inlet channel connecting the inlet to the impeller, and wherein the pump housing has an end cap, and the upper wall of the heater housing is fixed to the end cap.

2. The heater pump of claim 1, wherein the inner wall and the outer wall are made of stainless steel material.

3. The heater pump of claim 1, wherein a diffuser is disposed within the pump chamber and has a plurality of guide vanes spaced from each other for guiding the water to the outlet.

4. The heater pump of claim 1, wherein the heating chamber is a sealed chamber which is filled with a thermally conductive material for transferring heat from the heating element to the inner wall, lower wall and outer wall of the heater housing.

5. The heater pump of claim 4, wherein the thermally conductive material is magnesium oxide powder.

6. The heater pump of claim 5, wherein the heating element is a spiral heating tube.

7. The heater pump of claim 6, wherein the spiral heating tube includes an aluminum tube.

8. The heater pump of claim 1, wherein the heater comprises a power controller which is electrically connected to a temperature sensor arranged to sense the temperature of the water in the pump housing to control operation of the heating element.

9. The heater pump of claim 1, wherein the pump housing is made of a material having a lower thermal conductivity than the material of the heater housing.

10. The heater pump of claim 1, further comprising a plurality of mounts fixed around the motor for mounting the pump.

11. The heater pump of claim 1, wherein the motor comprises a shaft, the shaft extends into the pump housing through a bushing, and the impeller is fixed to the shaft.

12. The heater pump of claim 1, wherein the outer wall, inner wall, and upper wall of the heater housing are integrally formed as a single piece monolithic structure.

13. The heater pump of claim 1, wherein the outer wall, inner wall, and lower wall of the heater housing are integrally formed as a single piece monolithic structure.

14. The heater pump of claim 1, further comprising a heater plug fixed to the end cap, and the heating element is electrically connected to the heater plug, wherein the heater comprises a power controller which is electrically connected to a temperature sensor arranged to sense the temperature of the water in the pump housing to control operation of the heating element.

15. A heater pump comprising:

a motor; and a pump assembly, the pump assembly comprising:

a pump housing having an inlet and an outlet;

an impeller; and a heater, wherein the heater comprises:

a heater housing; and a heating element, wherein the heater housing comprises an inner wall, an outer wall, an upper wall and a lower wall forming a heating chamber accommodating the heating element, the inner wall defines an inlet channel connecting the inlet to the impeller, and wherein the outer wall of the heater housing has a plurality of holes.

16. The heater pump of claim 15, wherein the heating element is a spiral heating tube.

17. The heater pump of claim 16, wherein the spiral heating tube has a tube made of a stainless steel material.

18. The heater pump of claim 15, wherein the pump housing has an end cap, and the upper wall of the heater housing is fixed to the end cap.

19. A heater pump comprising:

a motor; and a pump assembly, the pump assembly comprising:

a pump housing having an inlet and an outlet;

an impeller; and a heater, wherein the heater comprises:

a heater housing; and a heating element, wherein the heater housing comprises an inner wall, an outer wall, an upper wall and a lower wall forming a heating chamber accommodating the heating element, the inner wall defines an inlet channel connecting the inlet to the impeller, and wherein the pump assembly further comprises an end cap and a pump housing, the end cap, the inlet and the pump housing are integrally formed as a single piece monolithic structure.

20. The heater pump of claim 19, further comprising a heater plug fixed to the end cap, and the heating element is electrically connected to the heater plug.

* * * * *